US006437230B2

(12) United States Patent
Torii et al.

(10) Patent No.: US 6,437,230 B2
(45) Date of Patent: Aug. 20, 2002

(54) EFFECTOR APPARATUS IN ELECTRONIC MUSICAL INSTRUMENT

(75) Inventors: Katsuhiko Torii; Akira Murata, both of Hamamatsu (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 0 days.

(21) Appl. No.: 09/876,424

(22) Filed: Jun. 6, 2001

(30) Foreign Application Priority Data

Jun. 13, 2000 (JP) ..... 2000-176804
Sep. 28, 2000 (JP) ..... 2000-296374

(51) Int. Cl.[7] ..... G10H 1/32

(52) U.S. Cl. ..... 84/718; 381/63; 381/103; 381/118

(58) Field of Search ..... 84/630, 644, 707, 84/DIG. 9, DIG. 26, 718–721; 381/63–65, 118, 123, 103

(56) References Cited

U.S. PATENT DOCUMENTS 5,939,656 A * 8/1999 Suda ..... 84/630

FOREIGN PATENT DOCUMENTS

| | | |
|---|---|---|
| JP | 64-048574 | 2/1989 |
| JP | 08-079877 | 3/1996 |
| JP | 10-039869 | 2/1998 |
| JP | 10-304498 | 11/1998 |
| JP | 11-161266 | 6/1999 |

* cited by examiner

*Primary Examiner*—Jeffrey Donels
(74) *Attorney, Agent, or Firm*—Christie, Parker & Hale, LLP

(57) ABSTRACT

The present invention permits the parameters of at least one of the frequency characteristic adjusting circuit and the effect circuit in its DSP to be modified for providing the line-out jacks with an optimum music signal when its speaker (SP) switch is turned off with no headphone connected. When the headphone plug is connected with no headphone jack, the effect setting switch is assigned with a function of speaker system effect setting. When the headphone plug is connected with a corresponding headphone jack, the effect setting switch is assigned with a function of headphone effect setting. Also, upon judging that the headphone plug is connected with the headphone jack, the function of an equalizer (EQ) switch is disabled.

16 Claims, 7 Drawing Sheets

CPU
ROM
RAM
SB
PANEL SCAN CIRCUIT
OPERATION PANEL
KEYBOARD SCAN CIRCUIT
KEYBOARD
SOUND SOURCE CIRCUIT
ORIGINAL SOUND WAVEFORM MEMORY
FREQUENCY CHARACTERISTIC ADJUSTING CIRTUIT
EFFECT CIRCUIT
10 (DPS)
D/A CONVERTER
30 (SP SWITCH)
L
R
21L (LINE-OUT JACK)
21R (LINE-OUT JACK)
23 (HEADPHONE JACK)

| SIGNAL LINE 23a (HEADPHONE DETECTION SIGNAL) | SIGNAL LINE 30a (SP SWITCH DETECTION SIGNAL) | OPTIMUM TERMINAL |
|---|---|---|
| L (PLUG IS INSERTED) | L (OFF) | HEADPHONE JACK |
| H (NO PLUG) | H (ON) | BUILT-IN SPEAKER |
| H (NO PLUG) | L (OFF) | LINE-OUT JACK |
| L (PLUG IS INSERTED) | H (ON) | HEADPHONE JACK |

| HEADPHONE DETECTION SIGNAL | LINE-OUT DETECTION SIGNAL | FUNCTION OF EFFECT SETTING SW |
|---|---|---|
| L (PLUG IS INSERTED) | H (NO PLUG) | HEADPHONE EFFECT SETTING |
| H (NO PLUG) | L (PLUG IS INSERTED) | LINE-OUT EFFECT SETTING |
| H (NO PLUG) | H (NO PLUG) | SPEAKER SYSTEM EFFECT SETTING |
| L (PLUG IS INSERTED) | L (PLUG IS INSERTED) | HEADPHONE EFFECT SETTING |

CPU
ROM
RAM
SB
PANEL SCAN CIRCUIT
OPERATION PANEL
KEYBOARD SCAN CIRCUIT
KEYBOARD
SOUND SOURCE CIRCUIT
ORIGINAL SOUND WAVEFORM MEMORY
FREQUENCY CHARACTERISTIC ADJUSTING CIRTUIT
EFFECT CIRCUIT
10 (DPS)
D/A CONVERTER
23 (HEADPHONE JACK)

EFFECTOR APPARATUS IN ELECTRONIC MUSICAL INSTRUMENT

CROSS-REFERENCE TO RELATED APPLICATIONS

This application claims priority of Japanese patent applications numbers 2000-176804, and 2000-296374, filed Jun. 13, 2000 and Sep. 28, 2000, respectively

BACKGROUND OF THE INVENTION

1. Field of the Invention

The present invention relates to an output effector apparatus in an electronic musical instrument such as an electronic piano, an electronic organ, or a single keyboard and particularly, to an output effector apparatus in an electronic musical instrument capable of providing a headphone, a set of speakers, and a line output with a music signal of quality sound depending on the connecting state of the headphone and speakers.

2. Description of the Related Art

One of such prior arts is disclosed in Japanese Patent Laid-open Publication (Heisei)10-39869. The prior art is provided in an electronic music instrument having a headphone and a set of speakers where, when its headphone plug is connected with no headphone jack, the speakers are supplied with a music signal which has been frequency compensated for them. When the headphone plug is connected with the headphone jack, the output of the music signal is shifted to the headphone which is thus supplied with the music signal frequency compensated for the headphone output. As described, the prior art can generate and provide a music signal of quality sound to both the headphone and the speakers.

Each modern electronic instrument such as electronic piano is equipped with line-out jacks for connection with external speakers in addition to the headphone and the speakers. When such an electronic instrument is provided with the prior art, its line-out jacks receive a music signal which exhibits an optimum level on the built-in speakers. This causes the external speakers connected to the line-out jacks to be hardly loaded with a music signal which exhibits an optimum level on the external speakers.

Also, the electronic musical instrument has an EQ (equalizer) switch provided on an operation panel thereof for modifying the tone of a music signal to match the ambient conditions. When the EQ switch is turned on, the electric characteristics of the built-in speakers are set to a DSP (digital signal processor) in the electronic musical instrument. Accordingly, with the EQ switch turned on and the built-in speakers loaded with the music signal, the electronic musical instrument can produce an optimum level of sounds which matches the ambient conditions.

For example, when the electronic musical instrument is located close to a wall, its sound may be more emphasized in the bass range than located in the center of an extensive room. By turning the EQ switch on, a difference in the tone of sound between the two locations can be eliminated to constantly have an optimum level of sound regardless of the location of the electronic musical instrument.

However, when the EQ switch is turned on with the headphone jack connected with a headphone, the headphone may receive a music signal of unfavorable level. Since the EQ switch functions to provide the built-in speaker with the music signal of an optimum level, it hardly permits the headphone to generate an optimum level of sound.

SUMMARY OF THE INVENTION

It is hence an object of the present invention to provide an electronic musical instrument having line-out jacks with a music signal which is optimum for any of the headphone, the built-in speakers, and the external speakers.

It is another object of the present invention to allow the function of the EQ switch not to disturb a headphone when connected to the headphone jack for receiving a music signal.

In order to achieve the object, the invention is firstly characterized in that an effector apparatus in an electronic musical instrument having a headphone jack, a set of built-in speakers, and a line-out jack, comprises a detecting means for detecting whether or not the headphone plug is inserted into the headphone jack, a speaker switch for controlling the supply of a music signal to the built-in speakers, and a controlling means arranged responsive to a detection signal from the detecting means and a switching on or off signal from the speaker switch for modifying the tone of a music signal which is fed to the headphone jack, the built-in speakers, and the line-out jack.

This permits the music signal to be modified in response to the detection signal from the detecting means and the on or off signal from the speaker switch to have an optimum level for output to any of the headphone jack, the built-in speakers, and the line-out jacks.

The invention is secondly characterized in that an effector apparatus in an electronic musical instrument having at least a headphone jack and a set of built-in speakers, comprises a detecting means for detecting whether or not the headphone plug is inserted into the headphone jack, and an effect setting switch of which the function is determined from the examination whether or not the headphone plug is connected with the headphone jack, wherein the effect setting switch is assigned with the function of speaker system effect setting when it is judged by the detecting means that the headphone plug is connected with no headphone jack and the function of headphone effect setting when it is judged that the headphone plug is connected with the headphone jack.

This allows the effect setting switch to be assigned with the function of speaker system effect setting when the headphone jack is connected with no headphone plug and the function of headphone effect setting when connected with a corresponding headphone plug. Accordingly, the optimum level of a music signal can automatically be provided regardless of the connection of the headphone jack with a a corresponding headphone plug.

The invention is thirdly characterized in that an effector apparatus in an electronic musical instrument having at least a headphone jack and a set of built-in speakers, comprises a tone modulating switch for controlling the tone of a music signal emitted from the built-in speakers; and a detecting means for automatically detecting the connection of the headphone plug with a headphone jack when the headphone plug is inserted into the headphone jack, wherein the function of the tone modulating switch is disabled when it is judged by the detecting means that the headphone plug is connected with the headphone jack.

This permits the function of the tone adjusting switch to be disabled when the headphone jack is connected with a corresponding headphone plug. Accordingly, the effect of the tone adjusting switch can be canceled during the use of a headphone thus allowing the headphone to emit an optimum level of sound.

DETAILED DESCRIPTION OF THE PREFERRED EMBODIMENTS

Figure 1:
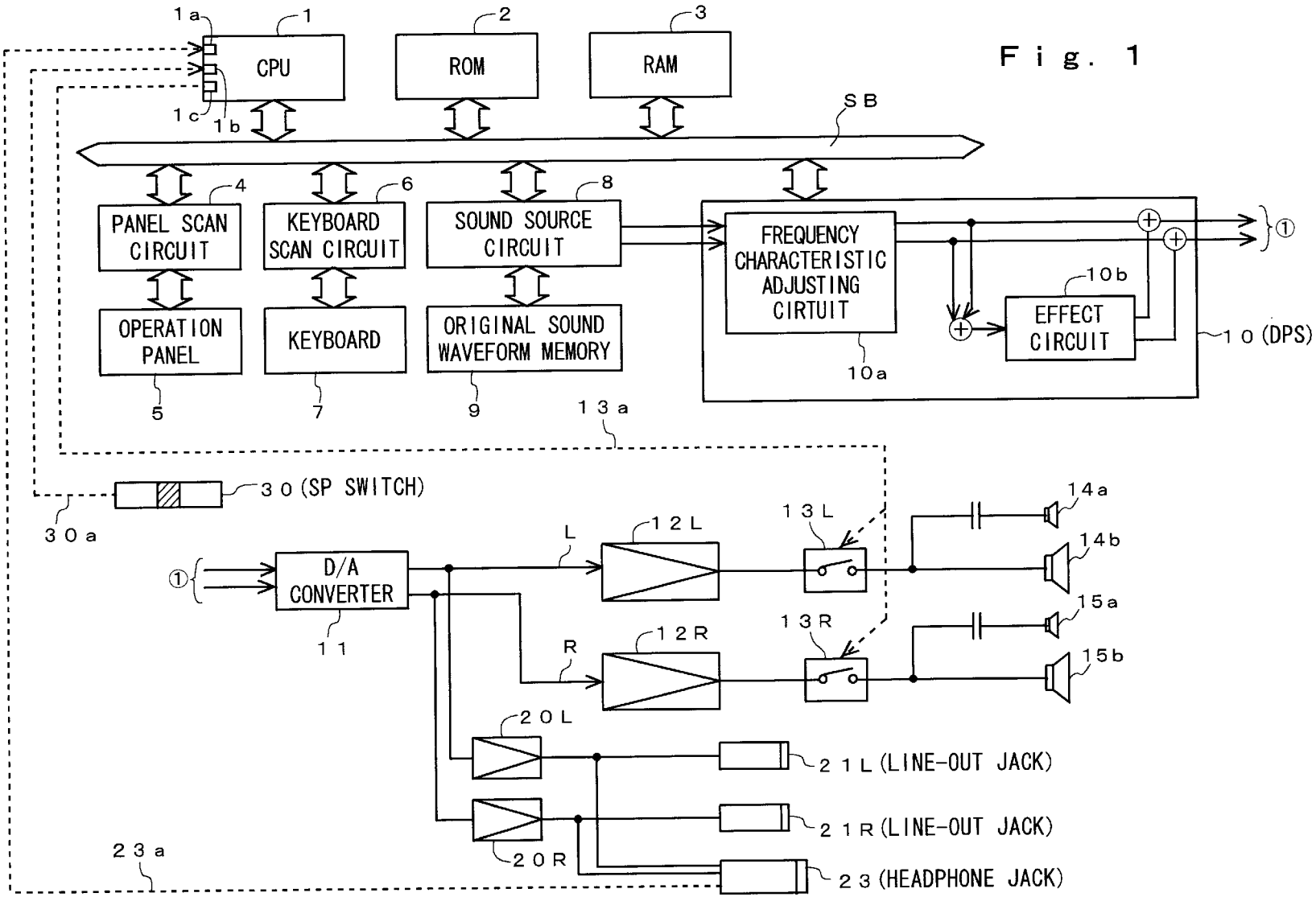
FIG. 1 is a block diagram showing one embodiment of the present invention.

The present invention will be described in more detail referring to the relevant drawings. FIG. 1 is a block diagram showing one embodiment in an electronic musical instrument (e.g. an electronic piano) according to the present invention.

As shown, a central processing unit (CPU) 1 controls the operation of each component with the use of a control program stored in a program memory of a ROM 2. The ROM 2 also holds a variety of specific data handled by the CPU 1 in addition to the control program for controlling the operation of each component of the electronic musical instrument. The control program and the specific data can be accessed via a system bus SB by the CPU 1. A RAM 3 holds status data and saves a working area for the CPU 1. The RAM 3 also contains various registers and flags for controlling the action of the electronic musical instrument and can thus be accessed via the system bus SB by the CPU 1.

An operation panel 5 has a group of switches, including a power switch and a tone control switch, and a display(s) for displaying given information. A panel scan circuit 4 examines the set/reset state of each switch mounted on the operation panel 5 and when finding the turn-on state of a switch, transfers the state of the switch as a detection signal to the CPU 1.

A keyboard 7 comprises an array of keys and an array of switches for opening and closing linked with the keys touched. A keyboard scan circuit 6 examines the on or off state of each key switch, generates from a signal of the on or off state a touch data indicative of the strength (velocity) of the key touch action, and releases the on or off state signal and its corresponding key number. The on or off state signal, the key number, and the touch data are transferred via the system bus SB to the CPU 1.

In response to the signal from the CPU 1, a sound source circuit 8 reads out a waveform of the original sound from a original sound waveform memory 9 and multiplies the waveform by an envelope to develop a music signal (a) which is transferred to a DSP (digital signal processor) 10. The DSP 10 includes a frequency characteristic adjusting circuit 10*a* as a primary component according to the present invention and an effect circuit 10*b*. The frequency characteristic adjusting circuit 10*a* determines desired frequency characteristics for generating optimum sounds to be released from a headphone, built-in loudspeakers, and external loudspeakers. The effect circuit 10*b* generates various effects including reverb and chorus. The music signal outputted from the DSP 10 is converted into an analog signal by a D/A converter 11 and transmitted to main amplifiers 12L and 12R and headphone amplifiers 20L and 20R.

The music signals amplified by their corresponding main amplifiers 12L and 12R are l are transferred via relays 13L and 13R to treble speakers 14*a* and 15*a* and bass speakers 14*b* and 15*b* in a loudspeaker system. The music signals amplified by their corresponding headphone amplifiers 20L and 20R are transferred to a couple of line-out jacks 21L and 22L and a headphone jack 23.

In this embodiment, a speaker switch 30 (referred to as an SP switch hereinafter) is connected at its signal line 30*a* to one 1*b* of two input ports of the CPU 1. The other input port 1*a* of the CPU 1 is connected to a signal line 23*a* of the headphone jack 23. The signal line 30*a* carries an SP switch detection signal and the signal line 23*a* carries a headphone detection signal. An output port of the CPU 1 is also connected to a relay control line 13*a* for controlling the operation of the relays 13L and 13R. It is now assumed that the input port 1*b* of the CPU 1 receives an H level signal when the SP switch 30 is turned on and an L level signal when turned off.

Figure 2:
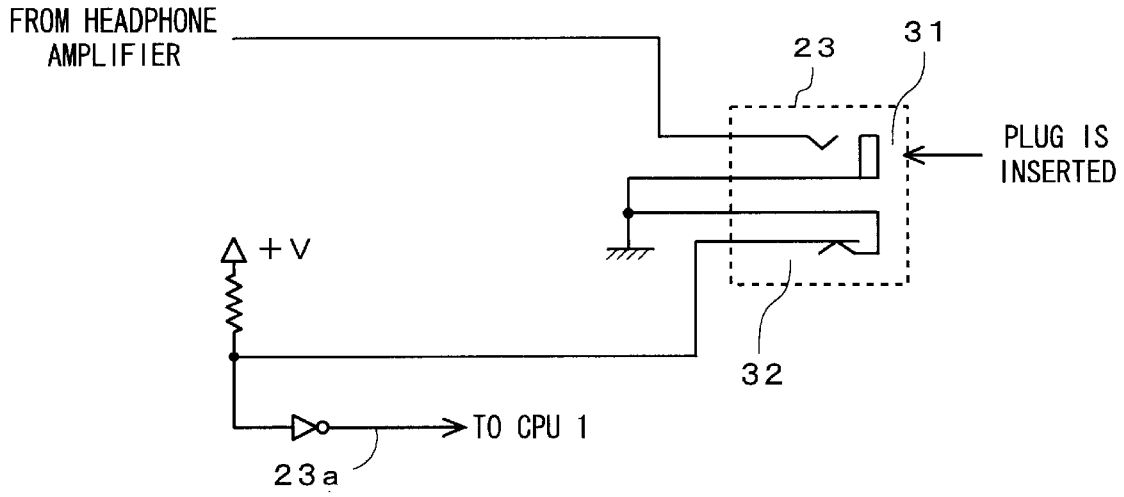
FIG. 2 is a diagram showing an internal arrangement of a headphone jack.

FIG. 2 is a circuitry diagram of an arrangement of the headphone jack 23. The headphone jack 23 comprises a jack 31 and a jack built-in switch 32. The signal line 23*a* extending from the jack built-in switch 32 to the CPU 1 is pulled up. When a plug is inserted into the jack 31 of the headphone jack 23, the jack built-in switch 32 is open to set the L level signal to the CPU 1. When the plug is withdrawn from the jack 31, the jack built-in switch 32 is closed to set the H level signal to the CPU 1. Accordingly, the CPU1 can judge whether or not the headphone jack 23 receives the plug.

Figure 3:
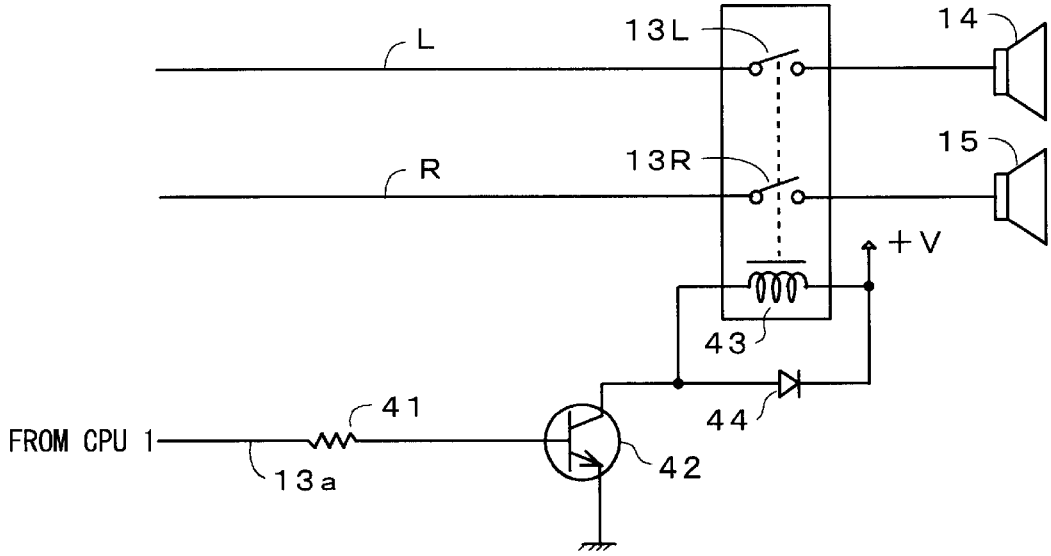
FIG. 3 is a diagram showing a relay controller circuit for controlling the connection of built-in speakers.

FIG. 3 is a diagram of a control circuit for the relays 13L and 13R. The control circuit comprises a resistor 41, an NPN transistor 42 connected at its base to the resistor 41, and a coil 43 and a diode 44 both connected to the collector of the transistor 42. When the transistor 42 receives the H level signal from the CPU 1, it turns on to energize the coil 43. This causes the relays 13L and 13R to switch on to supply the music signal with the speakers 14*a*, 14*b*, 15*a*, and 15*b*.

In reverse, when receiving the L level signal from the CPU 1, the transistor 42 turns off to deenergize the coil 43. As a result, the relays 13L and 13R are switched off not to supply the music signal with the speakers 14 and 15.

Figures 4, 5:
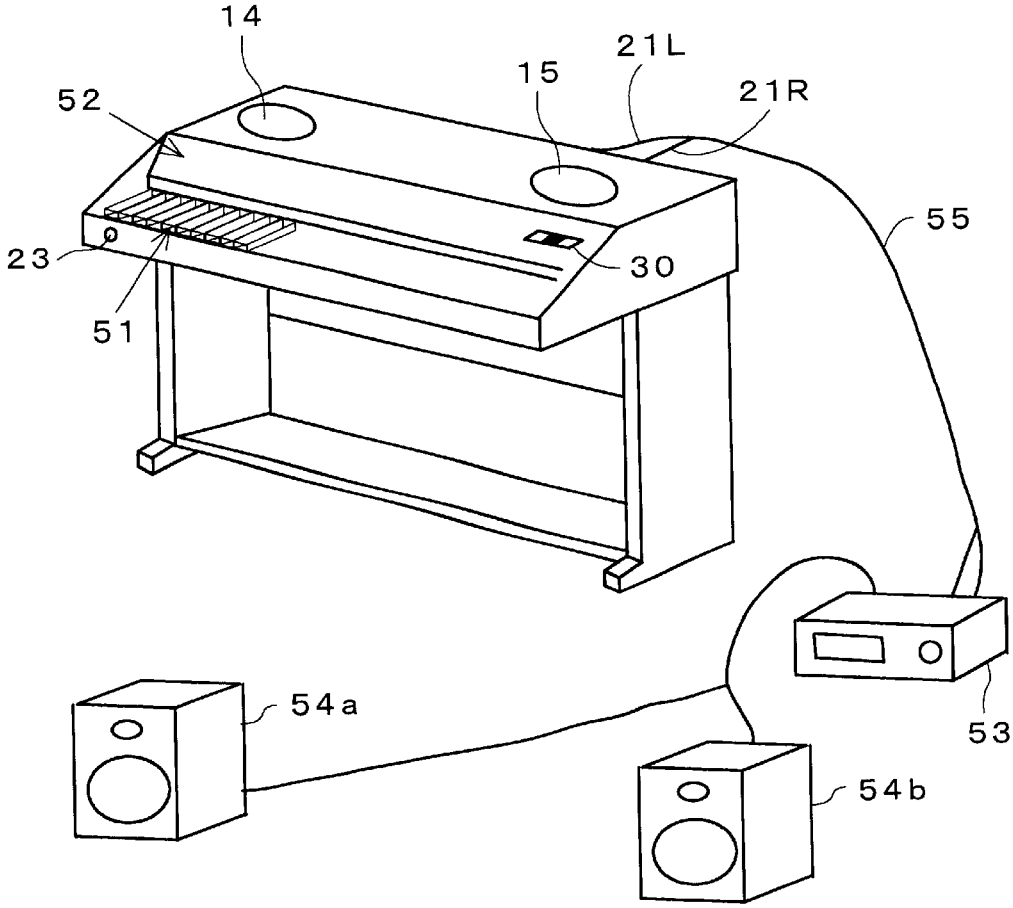
FIG. 4 is a table of operations of a CPU.
FIG. 5 is a schematic view of a system including an electronic piano associated with the present invention.

The operation of this embodiment will now be described referring to FIGS. 1 to 4. FIG. 4 is an operation table of the CPU 1.

When the headphone plug is inserted into the headphone jack 23 and the SP switch 30 remains turned off, the input port 1*a* of the CPU 1 is fed with the L level signal and the input other port 1*b* is fed with the L level signal. Accordingly, the CPU 1 supplies the optimum music signal with the headphone jack 23 as shown in the operation table of FIG. 4. More specifically, as the frequency response of a common headphone is flat, the CPU 1 drives the DSP 10 to actuate the control circuit for producing an optimum (flat) frequency response to the headphone, e.g. a headphone dedicated circuit, and a favorably level of the effect (e.g. reverb) for the headphone. This may be implemented by the DSP 10 having a program of frequency characteristic adjusting circuit or modifying the parameters in the program for the effects including reverb and chorus.

Some types of the headphones which are commonly flat in the frequency response may emit treble range with difficulty while the other types without. If a type of the headphone emitting treble range with difficulty is connected, a compensation operation of emphasizing the treble range should be carried out. With a type of the headphone emitting more treble range, a compensation operation of attenuating the treble range should be made. In this manner, an optimum condition for using the headphone will be provided.

When the SP switch 30 remains turned on with the headphone jack 23 receiving no plug, both the input port 1*a* and 1*b* of the CPU 1 are loaded with the H level signal. Then, the CPU 1 supplies the optimummusic signal with the loudspeakers 14*a,* 14*b,* 15*a,* and 15*b* as shown in the operation table of FIG. 4. More specifically, the CPU 1 drives the DSP 10 to generate a desired frequency response curve compensated for releasing an optimum sound from the built-in speakers and to adjust the effect such as reverb to an optimum level for the built-in speakers.

Also, the following operations of compensation are desired depending on the layout of speakers.

(1) When no tweeters are provided, the treble range is absent, thus shall be enhanced.
(2) When tweeters are provided with the speakers facing the front, the treble range is abundant, thus shall be attenuated.
(3) When the speakers are provided with an enclosure, their output is too direct. Therefore their frequency response shall be modified to an optimum level.
(4) When no enclosure is provided, the bass range is absent, thus shall be enhanced.
(5) When the speakers face in other directions than the front, the treble range which is highly directional and easily declined, thus shall be enhanced.

Those compensating operations permit the speakers to emit optimum sounds to be perceived.

When the headphone jack 23 receives no plug with the SP switch 30 remaining turned off, the input port 1*a* of the CPU 1 is fed with the H level signal and the input port 1*b* is fed with the L level signal. The CPU 1 thus operates to emit an optimum music sound from the line-out jacks 21L and 21R as shown in the operation table of FIG. 4. More particularly, the CPU 1 drives the DSP 10 to generate a line-out signal which exhibits an optimum level for actuating external speakers. For the purpose, the frequency response of the line-out signal is set flat and arranged so that the level (depth) of the effect such as reverb is optimum on the external speakers.

When the SP switch 30 remains turned on with the headphone jack 23 receiving a plug, the DSP 10 is actuated to give priority to the headphone jack 23 through which the optimum music signal is delivered.

FIG. 5 illustrates a system of an electronic piano and external loudspeakers associated favorably with the embodiment of the present invention. The electronic piano has a keyboard 51 and an operation panel 52. A headphone jack 23 is provided on the front side of the electronic piano. The operation panel 52 has an SP switch 30 while built-in speakers 14 and 15 are mounted to the upper side of the electronic piano. A pair of line-out jacks 21L and 21R are provided on the rear side of the electronic piano. An audio amplifier 53 is connected at input end by an audio cable 55 to the line-out jacks 21L and 21R and at output end to the external loudspeakers 54*a* and 54*b*.

Using the embodiment of the present invention, the electronic piano or musical instrument can be played by a player at an optimum setting for each line of the outputs with carrying out no trouble some actions.

The present invention is not limited to the embodiment where the music signal is controlled by the DSP 10 for having optimum levels for the built-in speakers, the headphone, and the external speakers but may allow the output of a sound source to be controlled in the amplitude.

As described above, the embodiment of the present invention can determine the music signal to an optimum level for the headphone jack, the built-in speakers, or the line-out jacks depending on both the connection of a headphone plug and the on and off states of the SP switch. This allows the music signal to emit an optimum sound from the headphone, the built-in speakers, or the external speakers connected to the line-out jacks.

For emitting an optimum sound from the headphone jack, the built-in speakers, and the line-out jacks, the following settings are desired.

When the headphone plug is connected with a headphone jack which is commonly flat in the frequency response, the music signal is controlled by the operation of the DSP to have a flat frequency response and a level of the effect (e.g. reverb) desired for driving the headphone.

When the built-in speakers are selected for emitting the music sound, the music signal is controlled by the operation of the DSP to have a frequency curve compensated for emitting an optimum sound from the built-in speakers and a level of the effect such as reverb optimum for the built-in speakers. Also, the frequency response has to be modified by the foregoing manners (1) to (5) depending on the layout of the built-in speakers.

When the line-out jacks are connected with external speakers which is commonly flat in the frequency response, the music signal can be controlled by the operation of the DSP to have a flat frequency response and a level of the effect such as reverb optimum for the external speaker.

In the prior art, no particular scheme is provided for releasing an optimum level of the music signal from the line-out jacks. The embodiment of the present invention permits the line-out jacks to deliver an optimum level of the music signal thus emitting an optimum level of sound from the external speakers.

The information about characteristics of the headphone or the external speakers and the layout of the built-in speakers may be inputted by the operator controlling the operation panel.

Figure 6:
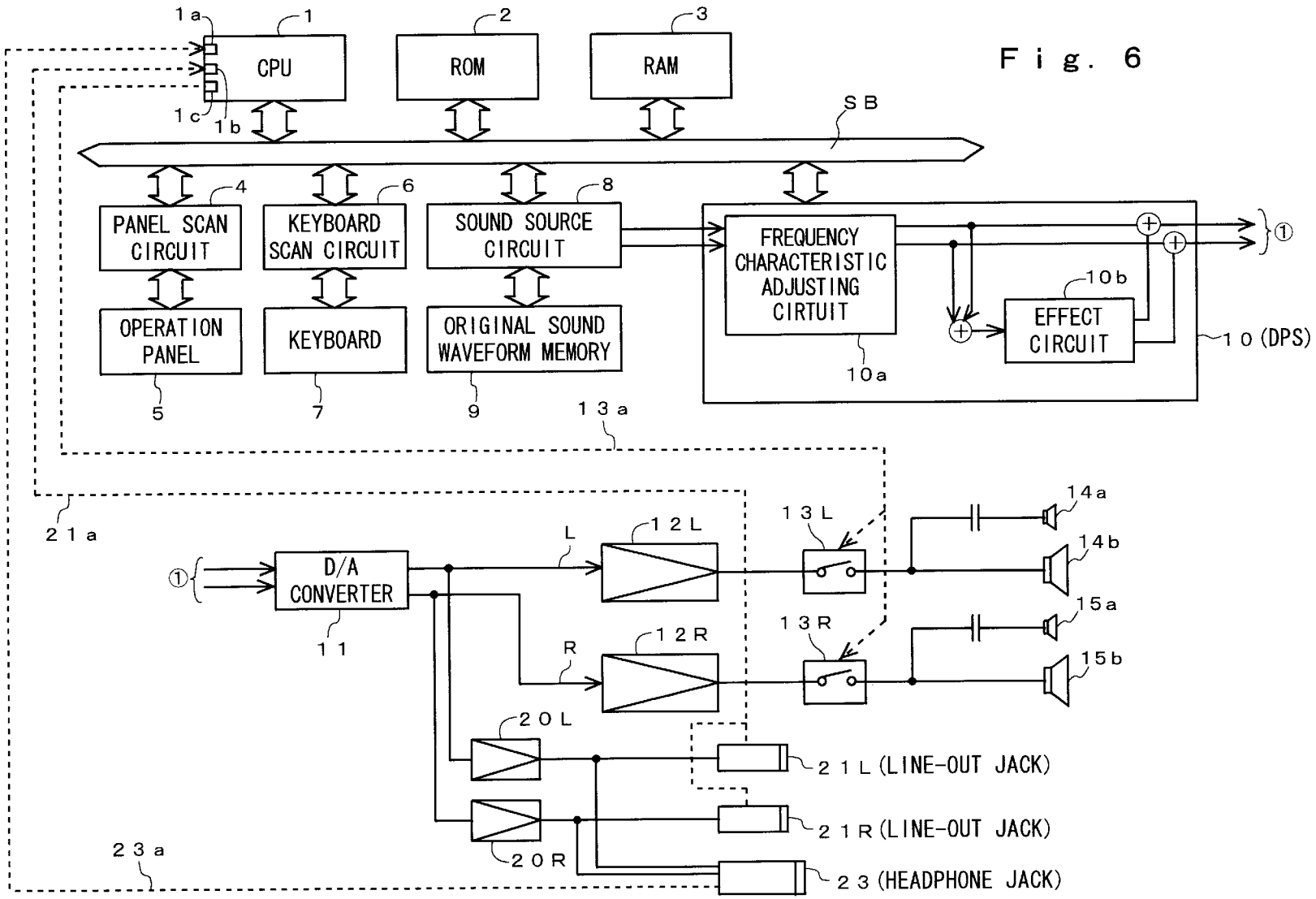
FIG. 6 is a block diagram showing a second embodiment of the present invention.

A second embodiment of the present invention will be described referring to FIG. 6. In FIG. 6, like components are denoted by like numerals as those shown in FIG. 1. In this embodiment, a pair of line-out jacks 21L and 21R are connected by a signal line 21*a* to a CPU 1 for providing a line-out detection signal over the signal line 21*a*. An effect setting switch is provided on an operation panel 5. The effect setting switch may be implemented by a single on/off switch or a rotary selector switch for selection from two or more different effects. The line-out jacks 21L and 21R may be identical in the construction to the headphone jack 23 shown in FIG. 2. Then, the CPU 1 receives an L level signal when plugs are inserted into the light-out jacks 21L and 21R and an H level signal when not.

Figures 7, 10:
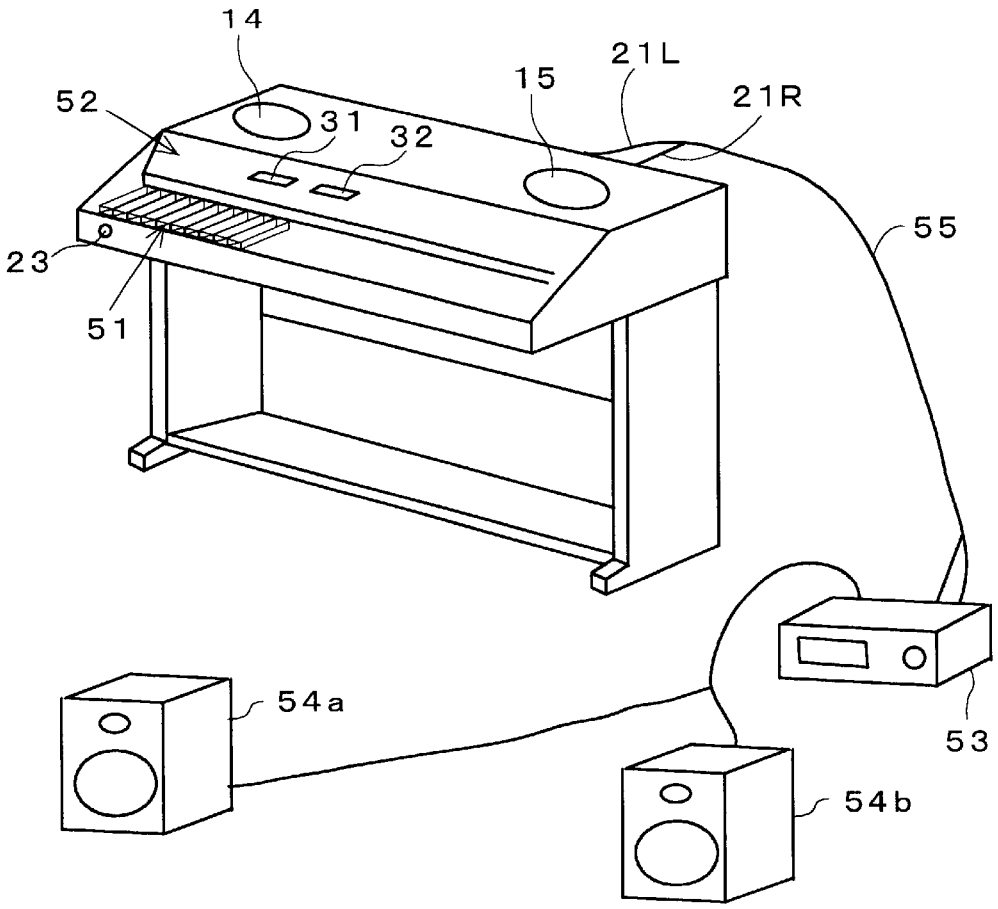
FIG. 7 is an operation table of a CPU in the second embodiment.
FIG. 10 is a schematic view of another system including an electronic piano associated with the present invention.

The CPU 1 of this embodiment is operated according to an operation table shown in FIG. 7. When the headphone jack 23 receives a headphone plug and plugs are not inserted into the line-out jacks 21L and 21R, the input port 1*a* of the CPU 1 is fed with the L level signal and the input port 1*b* is fed with the H level signal. As shown in the operation table of FIG. 7, the CPU 1 assigns a function of headphone effect setting to the effect setting switch on the operation panel for enabling a spreader circuit or a frequency response adjusting circuit for the headphone.

Different types of the headphone are available which are either high or low in the treble, bass, or medium range. The DSP 10 is thus arranged for containing predetermined levels of the electric characteristic assigned to the different headphones for emitting an optimum sound. The different levels of the electric characteristic can selectively be used by operating the effect setting switch. As the effect setting switch is selectively turned on, each type of the headphone can emit an optimum level of sound. It is known that the headphone produces a pattern of sound held at substantially a particular location in the head of the user and may provide a listener with a sense of fatigue when used for a long. This drawback can favorably be diminished or eliminated by using the spreader circuit for the headphone.

More particularly, for the purpose, the CPU 1 modifies the parameters in the programs for the effects including reverb, chorus, and spreading for the headphone or in the frequency characteristic adjusting circuit saved in the DSP 10. This operation may be applied to the following procedures.

When the CPU 1 receives at its input port 1*a* the H level signal and at its input port 1*b* the L level signal, it assigns a function of line-out effect setting to the effect setting switch as shown in the operation table of FIG. 7.

In general, the line-out terminals are connected with external speakers or a PA system on a stage. Those connections require substantially a flat frequency response. When the line-out jacks are selected, the setting is made for providing a flat electrical characteristic.

Also, the setting may selectively be made to develop a desired effect depending on the type of the external speakers. For example, the setting is selected from large-speaker effect setting, small-speaker effect setting, and output level effect setting. When the line-out terminals are connected with large sized speakers, the output may be emphasized in the bass range thus declining the balance of sound. The large-speaker effect setting is hence based on decreasing the bass range of the characteristic output. When small sized speakers are connected as the external speakers, the output may be emphasized in the treble range thus declining the balance of sound. The small-speaker effect setting is hence based on decreasing the treble range of the characteristic output. The output level effect setting involves modification of the characteristic output depending on the type of an apparatus to be connected with the line-out terminals.

When the CPU1 receives at both the input ports 1*a* and 1*b* the H level signals, it assigns a function of speaker system effect setting to the effect setting switch as shown in the operation table of FIG. 7. This allows the effect setting switch to act as the speaker system effect setting switch for enabling setting of the speaker spreader circuit and the frequency characteristic adjusting circuit.

It is also a good idea to select the effects depending on the location of the electronic musical instrument. For example, when the electronic piano is sited close to a wall, its electronic characteristic has to be modified to diminish the bass range of the output. In practice, various levels of the electric characteristics for releasing sounds of the optimum level in a highly reflective room, a less reflective room, a larger room, and a smaller room are saved in the DSP 10 and can be selected by the operation of the effect setting switch. When the electronic piano is located close to a wall, its output is arranged low in the bass range and can thus be perceived as a favorable sound by the player. When both the input ports 1*a* and 1*b* receive the L level signal, it is judged that a headphone is connected, because the priority is given to the headphone connection.

While the electric characteristics are modified by using the effect setting switch in the embodiment, it may systematically be saved for future use. More particularly, when the built-in speakers are connected, the effects for the speakers which the player has determined are initially saved as the assignments. Similarly, the effects for the headphone connection or the line-out connection can be set at the initial operation by the player and saved as the setting assignments. This permits the effects determined by the player (the user) depending on the type of output to be automatically saved as the setting assignments.

While the second embodiment has three different outputs arranged to be selected, the two outputs for the headphone and the built-in speakers may be allowed to be selected with the line-out connection excluded as used at a less frequency. This can eliminate one of the two input ports of the CPU 1. Also, the line-out jacks may be constructed with no switching mechanism. As a result, the overall cost will be declined.

The operation of the single on/off switch or the rotary selector switch for the effect setting may be replaced by a system mode. The requirement for the effect setting is saved in a backup memory or an external storage medium such as a floppy disk and when desired, read out together with EQ characteristic data, tone edit data, or played data. More specifically, the requirements can be read out and treated as parameters for exhibiting the personality of a player.

In this embodiment described above, the single (effect setting) switch is functioned corresponding to three different modes (the speaker play mode, the headphone play mode, and the line-out play mode). Accordingly, the number of switches employed can be minimized.

Figure 8:
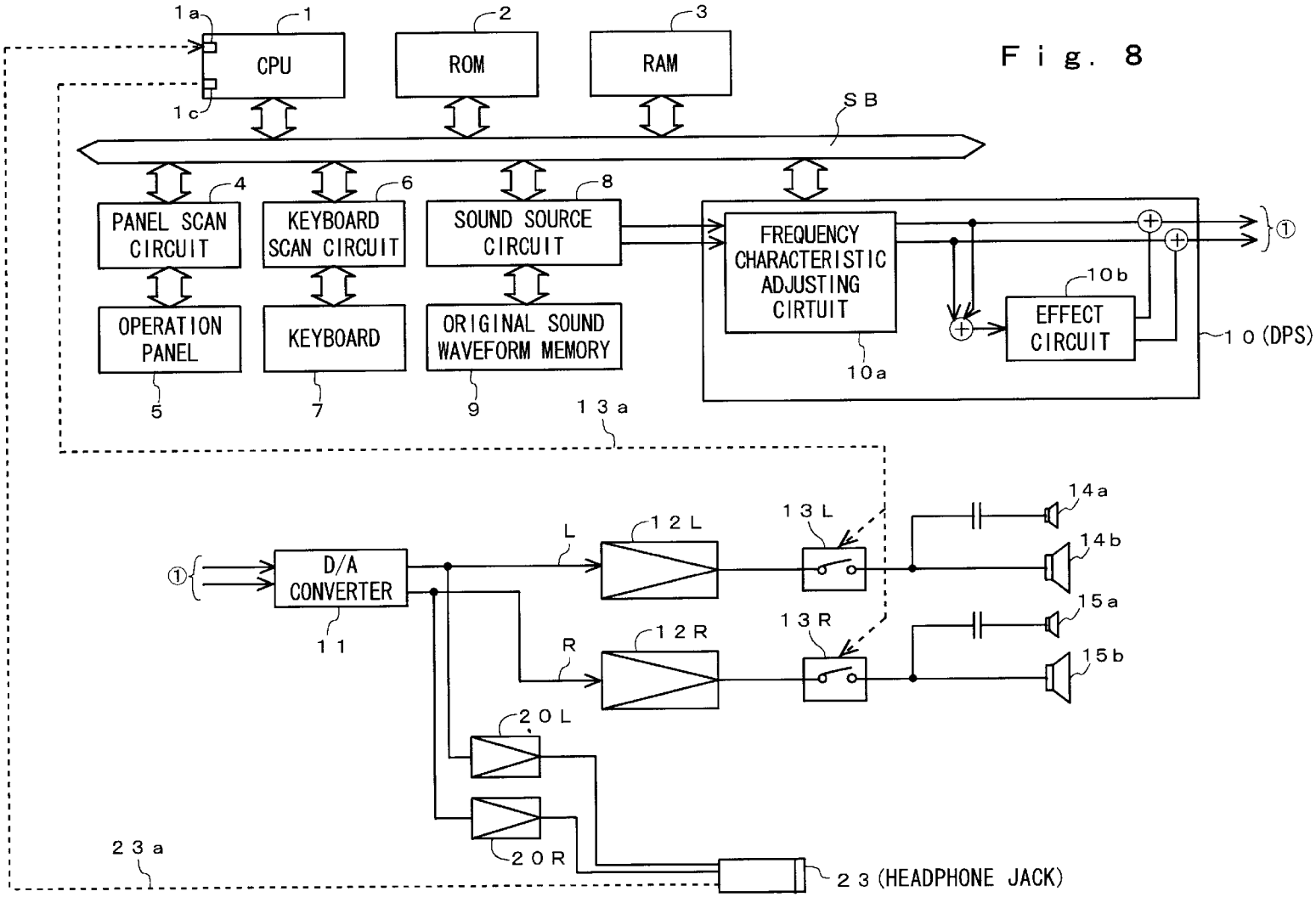
FIG. 8 is a block diagram showing a third embodiment of the present invention.

A third embodiment of the present invention will be described referring to FIG. 8. In this embodiment, the operation panel 5 has an EQ (equalizer) switch not shown. In FIG. 8, like components are denoted by like numerals as those shown in FIG. 1. A headphone jack 23 and a couple of relays 13L and 13R are identical to those shown in FIG. 2 and FIG. 3 respectively.

Figure 9:
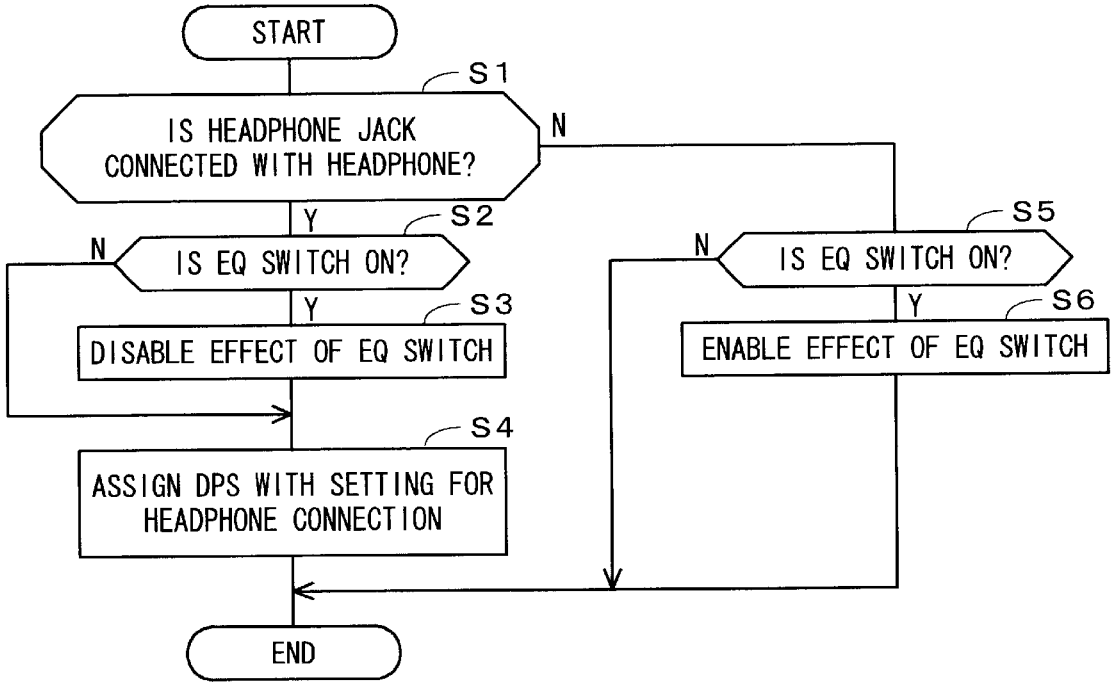
FIG. 9 is a flowchart of a procedure of primary operation of the third embodiment.

The operation of this embodiment is now explained referring to FIG. 9. FIG. 9 is a flowchart showing a procedure of operation of the CPU 1 in this embodiment.

The procedure starts with Step S1 where it is examined whether or not the headphone plug is connected with the headphone jack 23. The judgment may be made from examining the level of an input signal received at the input port 1*a* of the CPU 1. When the input signal is at the L (low) level, it is judged that the headphone plug is connected with the headphone jack 23. When the input signal is at the H (high) level, it is judged that the headphone plug is not connected with the headphone jack.

When it is judged positive at Step S1, the procedure goes to Step S2. It is examined at Step S2 whether the EQ switch is turned on or not. When so, the procedure advances to Step S3 where the effect of the EQ switch is disabled. Then, the setting desired for the headphone connection is loaded into the DSP 10 at Step S4. As a result, the DSP 10 enables the spreader circuit and the frequency characteristic adjusting circuit for the headphone, thus generating an optimum signal for the headphone.

When it is judged negative at Step S1, the procedure jumps to Step S5 where it is examined whether the EQ switch is turned on or not. When the EQ switch is turned on, the procedure goes to Step S6 where the effect of the EQ switch is enabled. As a result, the built-in speakers can emit an optimum music signal for the current state where the electronic musical instrument is situated. When it is judged negative at Step S5, the procedure is terminated.

As set forth above, this embodiment allows the effect of the EQ switch, even if remaining turned on, to be disabled when the headphone jack is connected with the headphone. Accordingly, once the headphone is connected to the headphone jack by the player, it can receive an optimum music signal without turning off the EQ switch. FIG. 10 is a view of a system including an electronic piano and external speakers according to the present invention. The electronic piano has an operation panel 52 provided with an EQ switch 31 and an effect setting switch 32. The other components are identical to those shown in FIG. 5.

As clearly understood from the above description, the present invention permits the music signal to be provided at its optimum level depending on the connection of a headphone plug with the headphone jack or of corresponding plugs of the external speakers with the line-out jacks. Also, the electronic musical instrument can be played by any player at an optimum setting for each line of the outputs with carrying out no troublesome actions.

What is claimed is:

1. An effector apparatus in an electronic musical instrument having a headphone jack, a set of built-in speakers, and a line-out jack, comprising:

a detecting means for detecting whether or not a headphone plug is connected with the headphone jack;

a speaker switch for controlling the supply of music signals to the set of built-in speakers; and a controlling means responsive to a detection signal from the detecting means and a switching signal from the speaker switch for modifying a tone of a music signal which is fed to the headphone jack, the built-in speakers, and the line-out jack.

2. An effector apparatus in an electronic musical instrument according to claim 1, wherein the controlling means modifies the tone of the music signal which is fed to the headphone jack, the built-in speakers, and the line-out jack by adjusting parameters of at least one frequency characteristic adjusting circuit and an effect circuit in a digital signal processor (DSP).

3. An effector apparatus in an electronic musical instrument according to claim 1, wherein the controlling means modifies the tone of the music signal, which is fed to the line-out jack, when the headphone plug is not connected with the headphone jack and the speaker switch is blocking the supply of the music signal to the set of built-in speakers.

4. An effector apparatus in an electronic musical instrument according to claim 2, wherein the controlling means modifies the tone of the music signal, which is fed to the line-out jack, when the headphone plug is not connected with the headphone jack and the speaker switch is blocking the supply of the music signal to the set of built-in speakers.

5. An effector apparatus in an electronic musical instrument having at least a headphone jack and a set of built-in speakers, comprising:

a detecting means for detecting whether or not a headphone plug is inserted into the headphone jack; and an effect setting switch, wherein the effect setting switch is assigned with the function of a speaker system effect setting when the detecting means detects that the headphone plug is not inserted into the headphone jack and the function of headphone effect setting when the detecting means detects that the headphone plug is inserted into the headphone jack.

6. An effector apparatus in an electronic musical instrument according to claim 5, wherein the speaker system effect setting is based on setting of electric characteristics depending on the location of the electronic musical instrument.

7. An effector apparatus in an electronic musical instrument according to claim 5, wherein the speaker system effect setting is based on setting of electric characteristics depending on properties of the headphone.

8. An effector apparatus in an electronic musical instrument according to claim 5, wherein the speaker system effect setting and the headphone effect setting are based on setting of the electric characteristics by the user.

9. An effector apparatus in an electronic musical instrument according to claim 5, further comprising:

a set of line-out jacks, each corresponding to a respective plug; and a detecting means for detecting that respective plugs are inserted into the corresponding line-out jacks, wherein the effect setting switch is assigned with the function of external speaker effect setting when the detecting means detects that the plugs are inserted into their corresponding line-out jacks.

10. An effector apparatus in an electronic musical instrument according to claim 9, wherein the external speaker effect setting is based on setting of electric characteristics depending on properties of the external speakers.

11. An effector apparatus in an electronic musical instrument according to claim 9, wherein the external speaker effect setting is based on setting of electric characteristics by the user.

12. An effector apparatus in an electronic musical instrument having at least a headphone jack and a set of built-in speakers, comprising:

a tone modulating switch for controlling tone of a music signal emitted from the built-in speakers; and a detecting means for automatically detecting connection of a headphone plug with the headphone jack when the headphone plug is inserted into the headphone jack, wherein the function of the tone modulating switch is disabled when the detecting means detects that the headphone plug is connected with the headphone jack.

13. A method for correcting music sound in an electronic musical instrument having a headphone jack, a set of built-in speakers, and a line-out jack, the method comprising the steps of:

detecting whether or not a headphone plug is connected to the headphone jack;

controlling the supply of music signals to the set of built-in speakers; and modifying a tone of a music signal fed to the headphone jack, the built-in speakers, and the line-out jack responsive to the detecting and the controlling steps.

14. The method of claim 13, wherein the modifying step comprises the steps of:

receiving a first signal if the headphone plug is connected to the headphone jack;

receiving a second signal if music signals are supplied to the set of built-in speakers; and responsive to the first signal and the second signal, modifying the tone of the music signal fed to the headphone jack, the built-in speakers, and the line-out jack.

15. The method of claim 13, wherein the modification step comprises the step of adjusting parameters of a frequency characteristic adjusting circuit and an effect circuit in a digital signal processor (DSP).

16. An effector apparatus in an electronic musical instrument having a headphone jack, a set of built-in speakers, and a line-out jack, comprising:

a detector for detecting whether or not a headphone plug is connected with the headphone jack;

a speaker switch for controlling the supply of music signals to the set of built-in speakers; and a controller for modifying a tone of a music signal which is fed to the headphone jack, the built-in speakers, and the line-out jack responsive to a detection signal from the detecting means and a switching signal from the speaker switch.

* * * * *